US007003439B2

(12) United States Patent
Aldred et al.

(10) Patent No.: US 7,003,439 B2
(45) Date of Patent: Feb. 21, 2006

(54) INTERACTIVE METHOD FOR REAL-TIME DISPLAYING, QUERYING AND FORECASTING DRILLING EVENT AND HAZARD INFORMATION

(75) Inventors: Walter D. Aldred, Houston, TX (US); William Wright, Houston, TX (US); Iain Rezmer Cooper, Sugar Land, TX (US); John Fuller, Farnham (GB); Shuja Goraya, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 729 days.

(21) Appl. No.: 09/772,546

(22) Filed: Jan. 30, 2001

(65) Prior Publication Data

US 2002/0103630 A1 Aug. 1, 2002

(51) Int. Cl.
*G06G 7/48* (2006.01)

(52) U.S. Cl. ..... 703/10; 702/9; 175/45

(58) Field of Classification Search ..... 703/10; 175/24–27, 40, 50, 61, 45; 702/9
See application file for complete search history.

(56) References Cited

U.S. PATENT DOCUMENTS

| | | | | |
|---|---|---|---|---|
| 5,318,136 A | | 6/1994 | Rowsell et al. | |
| 5,390,748 A | * | 2/1995 | Goldman | 175/24 |
| 5,508,915 A | | 4/1996 | Tsao et al. | |
| 5,555,531 A | * | 9/1996 | Booth et al. | 367/15 |
| 5,678,643 A | * | 10/1997 | Robbins et al. | 175/45 |
| 5,704,436 A | | 1/1998 | Smith et al. | |
| 5,730,234 A | | 3/1998 | Putot | |
| 5,794,720 A | | 8/1998 | Smith et al. | |
| 5,812,068 A | | 9/1998 | Wisler et al. | |
| 5,952,569 A | * | 9/1999 | Jervis et al. | 73/152.01 |
| 5,999,891 A | * | 12/1999 | Rey-Fabret et al. | 702/151 |
| 6,002,985 A | | 12/1999 | Stephenson | |
| 6,021,377 A | | 2/2000 | Dubinsky et al. | |
| 6,101,444 A | * | 8/2000 | Stoner | 702/9 |
| 6,109,368 A | | 8/2000 | Goldman et al. | |
| 6,152,246 A | | 11/2000 | King et al. | |
| 6,480,118 B1 | * | 11/2002 | Rao | 340/853.6 |
| 6,594,584 B1 | * | 7/2003 | Omeragic et al. | 702/9 |

FOREIGN PATENT DOCUMENTS

| | | |
|---|---|---|
| GB | 2 290 330 A | 12/1995 |
| SU | 1231946 A1 | 11/1995 |
| WO | WO 00/48022 | 8/2000 |

OTHER PUBLICATIONS

Borland et al., *Oilfield Review*, pp. 2-15, Real-Time Answers to Well Drilling and Design Questions, (Summer 1997).
Peter Aird, www.kingdomdrilling.co.uk, "Well Plan Template," (Sep. 15, 2000).

(Continued)

*Primary Examiner*—Russell Frejd
(74) *Attorney, Agent, or Firm*—Brigitte L. Echols; Bryan L. White; Victor H. Segura

(57) ABSTRACT

A method is disclosed for characterizing a drilling hazard. The method includes determining a well plan including at least a wellbore trajectory. A likelihood of occurrence of at least one drilling hazard is estimated. A severity of the at least one drilling hazard is estimated. The hazard is displayed on a representation of the wellbore trajectory, by indicating thereon a position of, the likelihood and the severity of the at least one drilling hazard.

33 Claims, 7 Drawing Sheets

OTHER PUBLICATIONS

YT Morozov, *Drilling of Guided and Multi-Bore Wells*, Ch. 5, pp. 128 - - 130, "Methods and Technology of Drilling Guided Wells," Nedra Publishing House, Leningrad, Russia (1976).

AS Volkov, BP Dolgov, GI Ponomarev, *Rotary Drilling of Test Wellbores*, pp. 257-258, "Wellbore Constructions," Nedra Publishing House, Moscow, Russia (1977).

D Dashevskiy, V Dubinsky & JD Macpherson, "Application of Neutral Networks for Predictive Control in Drilling Dynamics," *SPE 56442*, SPE Annual Tech. Conf. & Exh., Houston TX (Oct. 3-6, 1999).

WD Aldred, "Improving Drilling Efficiency through the Application of PERFORM*, Performance Risk Management," *SPE 57574*, SPE/IADC Middle East Drilling Tech. Conf., Abu Dhabi, UAE (Nov. 8-10, 1999).

J Holt et al., "Mungo Field: Improved Communications through 3D Visualization of Drilling Problems," *SPE 62523*, SPE/AAPG Western Regional Meeting, Long Beach CA (Jun. 19-23, 2000).

WC Sanstrom & MJ Hawkins, "Perceiving Drilling Learning through Visualization," *IADC/SPE 62759*, IADC/SPE Asia Pacific Drilling Tech., Kuala Lumpur, MY (Sep. 11-13, 2000).

W Wright et al., "Visualization: Game Changer, Facilitator or Gimmick?", *SPE/IADC 67754*, SPE/IADC Drilling Conf., Amsterdam NL (Feb. 27-Mar. 1, 2001).

W Aldred et al., "Managing Drilling Risk,"*Oilfield Review*, Summer 1999.

QJ Sharif, "A Case Study of Stuck Drillpipe Problems and Development of Statistical Models to Predict the Probability of Getting Stuck and if Stuck, the Probability of Getting Free," *PhD Dissertation, Texas A&M University* (May 1997).

N. Last et al., An Integrated Approach to Evaluating and Managing Wellbore Instability in the Cusiana Field, Colombia, South America, *SPE 30464*, SPE Annual Technical Conference and Exhibition, Dallas TX, Oct. 22, 1995-Oct. 25, 1995 (pp. 147-160).

* cited by examiner

| | | | | |
|---|---|---|---|---|
| 7 | 2725-2850m | 2040-2157m | 7) POTENTIAL BREAK-OUT USING 1.65 sg MUD WEIGHT | - MONITOR CAVING VOLUMES<br>- OBSERVE CAVING MORPHOLOGY |
| 8 | 2883-2925m | 2189-2228m | 8) POTENTIAL MUD LOSSES IN FRACTURED BALDERSELE IF ECD EXCEEDS 1.68 sg. | - KEEP ECD LOW(<1.68 sg)<br>- OBSERVE FOR LOSSES<br>- LCM MAY BE NECESSARY |

FIG. 7

| | | | | |
|---|---|---|---|---|
| 1 | 1350-1650m | 1103-1253.5 m | 1) POTENTIAL MUD LOSSES USING 1.65sg MUD WEIGHT | - KEEP ECD LOW<br>- OBSERVE FOR LOSSES<br>- LCM MAY BE NECESSARY<br>- MAINTAIN GOOD HOLE CLEANING |
| 2 | 1025-1900m | 941-1394m | 2) WELL INCLINATION BETWEEN 55-65 DEG. POSSIBLE AVALANCHING CUTTINGS BEDS. | - ENSURE GOOD HOLE CLEANING AND CAREFUL TRIPPING OF BHA THROUGH AND BELOW THIS ZONE |
| 3 | 1675-1828m | 1266-1351m | 3) POTENTIAL MUD LOSSES IF ECD EXCEEDS 1.68 sg | - KEEP ECD LOW (<1.68 sg)<br>- OBSERVE FOR LOSSES |
| 4 | 1850-2070m | 1364-1505m | 4) POTENTIAL BREAKOUT USING 1.65 sg MUD WEIGHT | - MONITOR CAVING VOLUMES<br>- OBSERVE CAVING MORPHOLOGY |
| 5 | 1980-2505 m | 1444.5-1844.5 m | 5) POTENTIAL LOSSES DUE TO FAULT ZONE | - KEEP ECD BELOW 1.70 sg<br>- MONITOR MUD LOSSES CAREFULLY<br>- MONITOR FOR FRACTURE RELATED CAVINGS<br>- AN INCREASE IN MUD WEIGHT NOT RECOMMENDED DUE TO DESTABILISATION |
| 6 | 1990-2070m | 1450-1500m | 6) POSSIBLE BEDDING PARALLEL FORMATION FAILURE. HIGH VOLUMES OF CAVINGS, DANGER OF | - MONITOR CAVING MORPHOLOGY FOR BEDDING PARALLEL FAILURE<br>- MAINTAIN GOOD HOLE HOLE CLEANING, REDUCE ROP IF CAVING VOLUME BECOMES EXCESSIVE WITH INCREASED HOLE CLEANING.<br>- DO NOT INCREASE MUD WEIGHT |

INTERACTIVE METHOD FOR REAL-TIME DISPLAYING, QUERYING AND FORECASTING DRILLING EVENT AND HAZARD INFORMATION

FIELD OF THE INVENTION

The invention is related generally to the field of drilling wellbores through earth formations. More specifically, the invention is related to methods for identifying drilling hazards, assessing the likely consequences of the hazards, and adjusting a well plan to reduce the consequences of the hazards.

BACKGROUND OF THE INVENTION

Wellbore drilling through earth formations for extracting fluids includes making a well plan or prognosis prior to starting drilling. A well plan generally includes the spatial position of earth formations that the wellbore is to penetrate, the path or trajectory of the wellbore from the earth's surface to the prospectively penetrated formations, and the depths in the wellbore, and sizes thereof, of protective pipe, or casing, which is used to protect the penetrated formations and to provide a conduit for formation fluids to flow to the earth's surface.

The ultimately planned wellbore trajectory depends on, among other factors, available drilling locations at the earth's surface (or the geographic location of a drilling vessel or drilling platform in offshore wells), and the relative spatial positions of the prospectively drilled formations. The casing depths depend on, among other factors, fluid pressures in the pore spaces of all the permeable formations to be drilled along the trajectory, formation fracture pressures and mechanical properties, and the ultimate depth and lateral extent of the wellbore.

In developing a well plan, a wellbore designer takes into account the possibility that the formations to be penetrated have excessive fluid pressure in the pore spaces, and whether exposed (already drilled), but shallower depth formations, are able to withstand (avoid fracturing by) hydrostatic pressure needed in the wellbore to control such excess pressures. Failure to withstand the hydrostatic pressure in the wellbore may result in loss of drilling fluid ("lost circulation"). Similarly, the well designer must consider whether exposed formations have fluid pressure such that control of higher pressure formations in the wellbore may increase the risk of having a drilling assembly become stuck in the wellbore due to differential fluid pressure across the lower pressure formations ("stuck pipe"). Other causes of stuck pipe can include caving of susceptible formations, which may result from chemical interaction of the formation with components of the drilling fluid, or from penetrating a formation having high mechanical stresses therein.

Failure to have sufficient hydrostatic pressure in the wellbore when drilling through certain formations may result in fluid influx to the wellbore (taking a "kick"). Taking a kick can be dangerous, particularly when the kick includes large quantities of gas, because hydrostatic pressure can be further reduced in the wellbore, causing consequent increase in influx. The ultimate result may be a "blowout" or uncontrolled discharge of fluid from the wellbore, or the kick may ultimately fracture a shallower, weaker formation.

Mechanical properties of the formations to be drilled, in combination with the well trajectory, can affect the dynamic response of the drilling assembly. In some cases, drill bits can wear out prematurely, or excessive vibrations in the drilling assembly can result in catastrophic component failure during wellbore drilling.

Undesirable occurrences during drilling, such as the foregoing examples, may be broadly characterized as "drilling hazards". In developing a well plan according to prior art methods, the wellbore designer uses available information about the subsurface earth formations and the proposed trajectory to avoid hazards which are known to exist or which have a very high probability of being encountered during drilling. For example, drilling through certain formations with insufficient hydrostatic pressure in the wellbore will most likely result in taking a kick in those formations. Prior art wellbore design techniques to avoid kicks include having sufficient hydrostatic pressure in the wellbore when drilling through such formations, while making sure that the hydrostatic pressure does not exceed estimated fracture pressure of any exposed earth formations. Information used in wellbore design to avoid known hazards includes earth formation characterization information, such as well logs and cuttings analysis from other wellbores in the vicinity of the proposed wellbore, surface seismic surveys, and formation pressure and/or production tests from nearby wellbores. For proposed wellbores for which such data are unavailable, the wellbore designer may use surface seismic survey information to estimate formation fluid pressures and depths at which such formations may be penetrated. Data from wellbores drilled in more distant areas may also be used where formation mechanical properties are to be estimated for the prospective wellbore.

A limitation of prior art wellbore design techniques is that drilling hazards are generally characterized as either existing or not with respect to a particular proposed wellbore design. A proposed wellbore design which is determined to almost certainly have such a drilling hazard may be adjusted by the wellbore designer to avoid the hazard. Similarly, wellbores being actively drilled may give indication of the near certainty of encountering a drilling hazard, which may result in a while-drilling modification to the well plan. Data acquired during drilling, such as from measurement-while-drilling and logging-while-drilling instruments may be used to adjust the well plan when an otherwise unforeseen drilling hazard is identified to high probability of occurrence. Actually encountering a drilling hazard typically results in at least some additional time and expense rectifying the damage from encountering the hazard.

In each of these situations, the wellbore designer does not have the ability, using prior art techniques, to determine the probability of encountering a drilling hazard for any particular well plan, to determine the likely severity of the consequences if such a hazard is encountered, and the magnitude of the economic cost or work cost necessary to repair any damage caused by encountering the drilling hazard.

Prior art drilling performance evaluation systems generally include methods for simulating the penetration of a bit through earth formations having selected mechanical properties, where selected drilling assembly and drilling operating parameters are entered into the system. The prior art systems provide a well designer with some ability to optimize the design of the drilling assembly and the operating parameters for particular types of earth formations. Typical prior art drilling evaluation and analysis systems are described, for example, in U.S. Pat. No. 6,021,377 issued to Dubinsky et al; U.S. Pat. No. 6,109,368 issued to Goldman et al; U.S. Pat. No. 5,704,436 issued to Smith et al; U.S. Pat. No. 5,794,720 issued to Smith et al; U.S. Pat. No. 5,318,136 issued to Rowsell et al; U.S. Pat. No. 6,002,985 issued to Stephenson; U.S. Pat. No. 5,730,234 issued to Putot; and U.S. Pat. No. 5,812,068 issued to Wisler et al. See also, D. Dashevskly et al, *Application of Neural Networks for Predictive Control in Drilling Dynamics,* paper no. 56442, Society of Petroleum Engineers, Richardson, Tex. (1999). None of the prior art describes any method or system for characterizing the risk and consequences of encountering drilling hazards.

Another technique for characterizing drilling hazards known in the art is called "3-D visualization". Generally speaking, a number of different types of geophysical interpretation, such as seismic, well log analysis, cuttings analysis and prior well histories are included in a common model of earth formations in the area surrounding a well to be drilled. The common earth model can be displayed in any one of a number of three dimensional computer generated graphic forms. Various proposed wellbore trajectories may be inserted onto the computer graphic representation. A description of 3-D visualization as is relates to wellbore planning can be found, for example, in, J. Holt et al, *Mungo Field: Improved Communication through 3D Visualization of Drilling Problems,* paper no. 62523, Society of Petroleum Engineers, Richardson, Tex. (2000). 3-D visualization techniques known in the art do not have the capability of predicting drilling hazards, so their usefulness is generally limited to the visualization itself.

What is needed is a system which enables a well designer to determine, from any one or more of a plurality of data sources, potential drilling hazards in a prospective wellbore, and for each of these hazards, a determination of the likelihood that each such hazard will be encountered, and a likely magnitude of consequences of encountering the hazard or the severity of the hazard. It is also desirable to have a system which may include data obtained during drilling of a wellbore which enables redetermination of the foregoing aspects of possible drilling hazards, and enables a wellbore designer to enter changes to a well plan therein to evaluate the likely effect of these changes in the well plan. Finally, it is desirable to have a system which enables a wellbore designer to optimize a well plan with respect to most likely consequences of encountering certain drilling hazards.

SUMMARY OF THE INVENTION

One aspect of the invention is a method is for characterizing a drilling hazard. The method according to this aspect of the invention includes determining a well plan. The well plan includes a wellbore trajectory. A likelihood of occurrence of at least one drilling hazard is estimated. A severity of the at least one drilling hazard is estimated. The hazard is displayed on a representation of the wellbore trajectory, by indicating thereon the likelihood and severity at the location of the hazard.

Another aspect of the invention is a method for optimizing a well plan. the method according to this aspect of the invention includes selecting an initial well plan having at least a wellbore trajectory. For the initial well plan, a position, likelihood, and severity of at least one drilling hazard are determined. At least one parameter of the initial well plan is changed, and the position, likelihood and severity of the at least one drilling hazard are recalculated. The changing and redetermining process is repeated in the planning of the wellbore until at least one of a most likely cost to drill a wellbore, an amount of lost time and a likelihood of encountering the at least one drilling hazard is minimized. In some embodiments of a method according to this aspect of the invention, the updating and refining of the well plan can be performed as the well is being drilled by using measurements obtained during drilling of the well. In some embodiments, the updating and refining of the well plan can be performed as the well is being drilled, in "Relevant Real Time" Where Relevant Real Time means that the updates are made in the time frame in which well planning and/or execution decisions need to be made.

Other aspects and advantages of the invention will be apparent from the following description and the appended claims.

DETAILED DESCRIPTION OF THE INVENTION

In its most general terms, the invention provides a framework to predict the likelihood of encountering, the severity of effect if encountered, and the most probable cost to remedy effects of encountering hazards during the drilling of a planned wellbore. Determination of these factors for each such drilling hazard is referred to herein for convenience as characterization of the drilling hazards. Types of drilling hazards are well known in the art. The causes of each type of drilling hazard are typically well known. These individual causes may be predicted quantitatively in some cases using methods known in the art, where a predetermined set of conditions are used in the quantitative analysis. In the invention, pre-drilling and while-drilling characterization may be performed by using the expected drilling conditions as a set of predetermined conditions to evaluate the individual probabilities of the existence each cause of each drilling hazard. These individual probabilities may be combined in some embodiments using a method according to Bayes's rule to characterize the drilling hazards for any proposed wellbore. In some embodiments, the individual probabilities may be recalculated during drilling of a particular wellbore, based on data obtained during drilling, so that the drilling hazards may be recharacterized.

Figure 1:
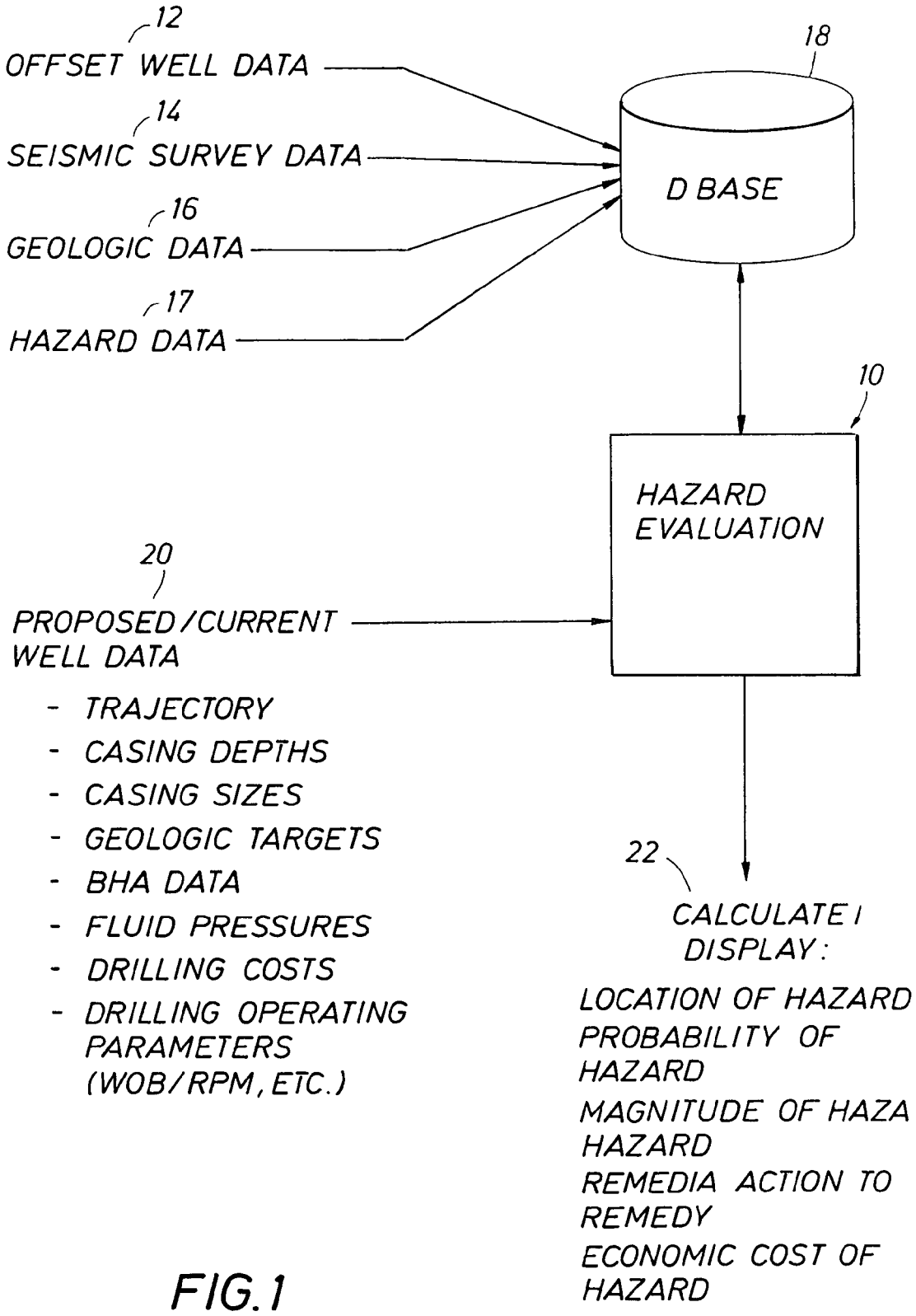
FIG. 1 shows a flow chart which describes the general framework in which the invention is used in well planning.

A general framework in which a method according to the invention may be used is shown in flow chart form in FIG. 1. As explained in the Background section herein, a risk of encountering and the consequences associated with encountering particular drilling hazards may be characterized by using data from various sources. For example, offset well data 12 may include information concerning the density of drilling fluid (mud weight) with respect to depth, wireline well log data (including, for example, electrical resistivity, acoustic velocity, density, neutron porosity, natural gamma radiation), formation fluid pressure test data, "leak off" test data (fluid pressure tests at each casing seat depth), wellbore directional survey data, and any data on drilling hazards encountered during drilling of wellbores in the vicinity of a proposed wellbore. The term "drilling hazards" as related to this invention is defined generally in the Background section herein and includes, but is not limited to, BHA component failure, taking a kick, formation fracture failure (indicated in some cases by lost drilling fluid circulation), and stuck pipe. The offset well data 12 may also include wellbore trajectories, bit sizes, casing depths, bottom hole assembly (BHA) configuration information (such as types and numbers of drill collars, stabilizers, mud motor information, bit type and diameter), and any other data related to the mechanics of the wells for which the data have been accumulated.

The offset well data 12, among other data, are stored in a database 18. The physical location of the database 18 is not meant to limit the invention, but as a matter of convenience may be located at the system operator's office facility or the like, and may be accessible such as by modem/telephone line, secure Internet connection or wireless connection for use at a remote location including the location of the proposed wellbore.

Where a proposed wellbore is to be drilled in an area not close to any other drilled wellbore, the offset well data 12 may be used to make estimates of likely earth formation properties in the proposed wellbore, using methods well known in the art. Such methods include making seismic survey estimates of the likely lithology and formation fluid pressures in the vicinity of the proposed wellbore, and searching the database 18 for wellbore drilling data from the most similar lithology and fluid pressure regimes. Seismic survey data 14, obtained at the earth's surface, ocean surface or ocean bottom in some cases, are also entered into the database 18. As is known in the art, seismic survey data are used to make estimates of subsurface formation fluid pressures and to make estimates of the depths and positions at which target earth formations may be located in the subsurface. Although the seismic survey data 14 may be stored in the database 18 in any suitable form such as raw shot records or correlated record sections, as a matter of convenience, the seismic data 14 preferably are stored in at least partially interpreted form. Estimates made from the seismic data, including but not limited to the foregoing examples which are useful in planning a well, are preferably stored in the database 18.

Geologic data 16, including for example, inferences on the lithology, fluid content and thicknesses of formations expected to be encountered in the proposed well, may also be entered into and stored in the database 18 in any convenient form. Where the seismic survey data 14 are entered into the database 18 in interpreted form, it may be convenient to include any of the geologic data 16 in a form which can be properly correlate to the interpreted seismic data for purposes of improving drilling hazard risk assessment, as will be further explained.

The database 18 also preferably includes data on encountered drilling hazards 17 which may be obtained from offset (nearby) wells, or from other drilled wells, such other drilled wells being preferably, but not necessarily in similar lithology and pressure regimes, and/or with similar trajectory shapes.). The term "trajectory shapes" as used herein refers to the overall geometric shape along the length of the wellbore and includes factors such as lateral extent from a surface location, and having changes in azimuth and/or inclination exceed particular rates ("dog leg severity"). The drilling hazard data 17 may include, for example, information on the type of hazard encountered, time the hazard was encountered, BHA configuration at the time of the hazard, mud weight (drilling fluid density) at the time of encountering the hazard, directional survey information from the well in which the hazard was encountered, the drilling operation being performed at the time the hazard was encountered, and the formations penetrated by the well at the time the hazard was encountered. The hazard data 17 also preferably include information on what remedial action was taken to overcome the hazard, whether the remedial action was successful, and the cost in either or both economic and effort terms to take the remedial action (which may require information about the time-incremental cost of running the drilling operation). As is the case for the geologic data 16, preferably the drilling hazard data 17 are correlated to interpreted versions of the seismic survey data 14 when entered into the database 18.

The foregoing data 12, 14, 16, 17 when stored in the database 18, provide a basis for evaluating prospective drilling hazards in a proposed wellbore. Generally speaking, a proposed wellbore will include data 20 on expected wellbore trajectory, expected casing depths, expected casing sizes, expected mud weights with respect to depth, expected formations to be penetrated, expected formation fluid pressures and fracture pressures, and costs to reach the projected target formations. The proposed well data 20, also referred to herein collectively as a "well plan" are entered into a computer 10, which can access the previously described data resident on the database 18, to calculate risk of encountering drilling hazards in the proposed well, the location of the hazards, and the expected magnitude and cost to remedy the hazards if encountered, as shown generally at 22. Generally speaking, the data 20 from the proposed wellbore are compared with hazard analysis from offset wells and any other available information about the formations in which the hazards were encountered, to make a quantitative estimate of the risk of encountering drilling hazards along the proposed wellbore. In preferred embodiments of the invention, a program operates on the computer 10 to make calculations related to the characteristics of drilling hazards, and displays them, in a manner such as explained below. The data 20 typically include elements such as the well trajectory, casing depths and sizes, the spatial position of target formations, bottom hole assembly (BHA) configuration, formation fluid pressures, incremental drilling costs, drill bit types and sizes, and proposed drilling operating parameters, including mud flow rate, rotary speed (RPM) and axial force on the bit (weight on bit —"WOB").

A preferred method for calculating risk of encountering drilling hazards is based on a method for generating and updating common earth models described in patent application Ser. No. 09/502,920, filed on Feb. 11, 2000 and assigned to the assignee of the present invention. Generally speaking, the method disclosed in the '920 application includes generating an initial parameterized model of earth formations. The initial model includes an estimate of the uncertainty of the model parameters. Data acquired from selected sources relevant to the model of the earth formations are then incorporated into an updated model which includes effects thereon of the acquired data. The updated model includes an updated estimate of the uncertainties of the model parameters. When any additional data are acquired, the model and the uncertainties of the model parameters are updated to include any effects of the additional data. The method described in the '920 application is based on Bayes's rule for calculating probability distribution functions.

In various embodiments of a method according to the invention, an initial model of the structure and fluid content of the earth formations, including pressures thereof, can be made from the previously described offset well data and/or surface seismic survey data ("initial earth model") and any correlative well date from more distant wells, as previously explained, where offset well data are unavailable. The initial earth model will include uncertainties as to various geologic structure parameters, such as zone thicknesses, earth formation spatial positions, and fluid pressures. Risk of encountering selected drilling hazards, and a most likely consequence of encountering any of the selected hazards may be constructed using techniques known in the art based on a proposed well plan, available drilling cost data, and by using a most likely set of parameters for the initial earth model.

Hazards may be characterized according to whether conditions likely to result in a hazard exist, given the initial earth model and the initial proposed well plan. For example, a risk of differentially stuck pipe may exist where a proposed mud weight exceeds a likely formation fluid pressure in an earth formation which is permeable. The magnitude of this risk maybe increased where the proposed wellbore trajectory include a high degree of likely contact between the wellbore wall and the drilling tool assembly. Such conditions will exist, for example, where the wellbore trajectory changes rapidly (high "dog leg severity"). Based on the initial earth model, and the proposed mud weight and dog leg severity, a risk of encountering a stuck pipe hazard may be characterized in any selected quantitative manner. The magnitude of the risk will depend at least in part on the uncertainty in the earth model. Those skilled in the art will appreciate that this uncertainty will be related to the quantity and relevance of the data used to generate the initial earth model. As one example, having a fluid pressure test in a particular earth formation will reduce the uncertainty of estimating the expected fluid pressure in a proposed wellbore where the proposed wellbore is highly likely to penetrate the same earth formation. Predictions about the existence of a stuck pipe or kick hazard, which depend to a great extent on formation fluid pressure estimates, will as a result have a much lower degree of uncertainty than predictions based only on seismic estimation of formation fluid pressure. The method for updating common earth models disclosed in the '920 patent application, for example, includes methods for calculating uncertainty of the model based on quantity and quality of data used to generate the model, based on Bayes's rule.

Figure 2:
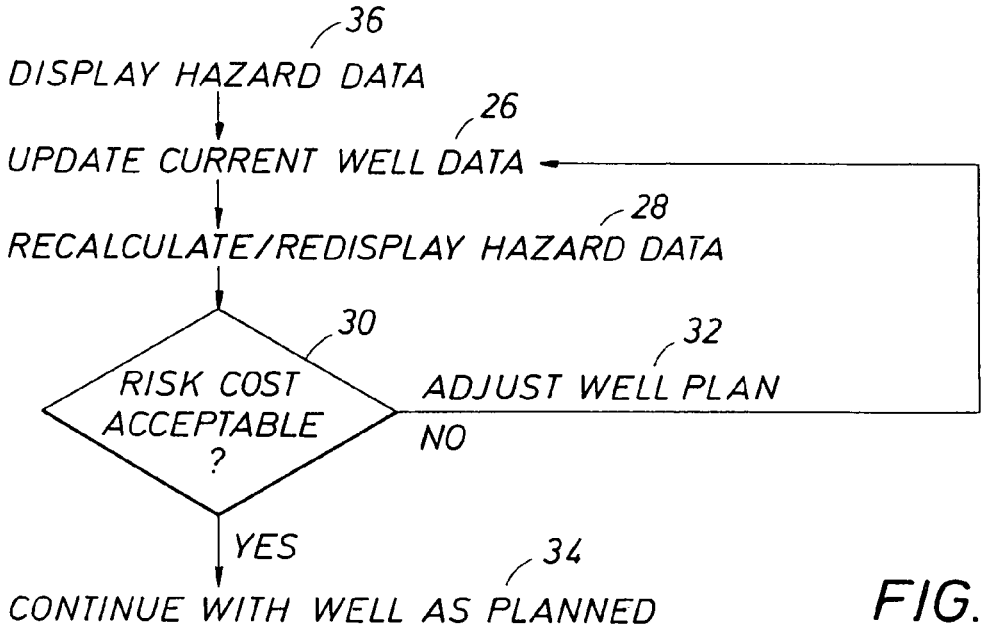
FIG. 2 shows a flow chart of one example of using a method according to the invention to adjust a well plan in response to changes in drilling hazard risk.

One example of using the drilling hazard risk and consequences thus determined is shown in general form in the flow chart of FIG. 2. The hazard information calculated as previously explained may be displayed 24 in any manner convenient for evaluation by a system operator. The term "system operator" or "operator" as used in this description is intended to mean a well drilling supervisor, drilling engineer, drilling rig supervisor or any other person charged with designing a well plan or constructing a wellbore according to a well plan. Examples of such displays will be explained later in more detail. At 26, the wellbore data are updated. Updating may take one of two general forms. A first such form includes data obtained while the proposed wellbore is actually being drilled, or a segment thereof has actually been drilled. These obtained data may include (but are not limited to), for example, wireline well log measurements, seismic checkshot survey measurements, formation fluid pressure measurements, actual casing depths, leak off test measurements, drilling fluid pressure measurements, and measurements which related the velocity of pipe movement to bottom hole drilling fluid pressure (swab and surge effect). Based on the data obtained from the wellbore as it is being drilled, the computer (10 in FIG. 1) may recalculate the relevant drilling hazard data (such as shown in FIG. 1 at 22). The recalculated hazard data 22 are displayed for evaluation at 28 in FIG. 2. In some embodiments, the recalculated hazard data 22 may be calculated by the computer (10 in FIG. 1) substantially in real time as the obtained data are measured and transferred to the computer. Other embodiments may enable the system operator to instruct the computer (10 in FIG. 1) to perform the recalculation at selected times, at selected time intervals, or upon specifically instructing the computer.

A second manner of updating the proposed well data includes adjusting any aspect, element or parameter of the proposed well plan, including, but not limited to, changing proposed casing depths, BHA configurations, drilling fluid densities at any depth in the wellbore, any of the proposed drilling operating parameters such as WOB and RPM and any part of the proposed wellbore trajectory. Changing the proposed well plan may be performed prior to commencement of any drilling on the well, or may be performed, as will be further explained, during the actual drilling of the wellbore so that adjustments to the uncompleted portion of the well plan may be made in the event any drilling hazards become more likely to be encountered, have more severe consequences, or have higher cost to remedy when recalculated to account for the data obtained during drilling of the wellbore.

For either type of drilling hazard calculation update, the drilling hazard data are displayed for evaluation, as shown at 28 in FIG. 2. At 30 in FIG. 2, the system operator or wellbore operator makes a determination as to whether any or all particular hazards displayed carry with them an acceptably small level of risk acceptably small consequences, acceptably small cost to remedy, or any combination thereof which in the judgment of the wellbore operator or system operator do not require changing the initial well plan. If this is the case, as shown at 34, the initial well plan will remain unchanged, and drilling may continue according to the initial well plan. If any of the identified drilling hazards carry what are believed to be any unacceptable combination of risk and/or consequences and/or cost to repair, the operator may, as shown at 32, adjust the drilling plan and cause the computer (10 in FIG. 1) to recharacterize the drilling hazards. This may require one or more iterations of adjusting the well plan 32 to find an adjusted well plan which has an acceptable combination of risk of encountering, consequences and/or cost to repair any particular drilling hazards.

Figure 3:
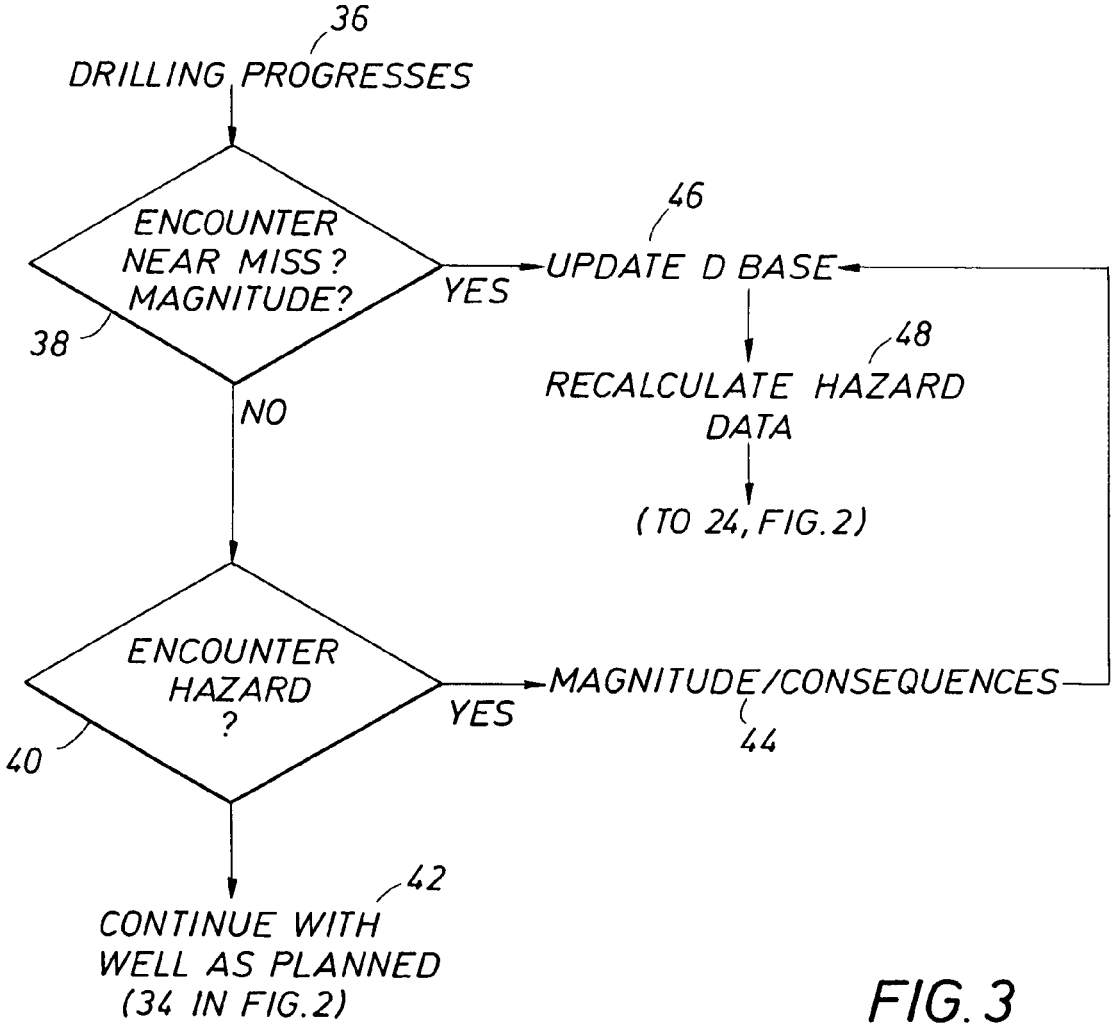
FIG. 3 shows a flow chart of one example of updating a database used to calculate drilling hazard risk in response to new data on drilling hazards.

As previously explained, various embodiments of the invention use any available data on the earth formations and drilling experience elsewhere to make quantitative estimates of the risk of, and consequences of, encountering drilling hazards in a particular wellbore. A particular feature of the invention, which is explained in general terms by reference to FIG. 3, includes updating the information in the database (18 in FIG. 1) and recharacterizing any drilling hazards determine in the proposed wellbore based on the new data resident in the database (18 in FIG. 1). Recharacterization, as previously explained, is typically performed on the computer (10 in FIG. 1). In some embodiments, as previously explained, the data used for recharacterization may be updated during the drilling of the wellbore. In some embodiments, also as previously explained, the data may be updated substantially in real time, such as where measurement-while-drilling (MWD) and/or logging-while-drilling (LWD) instrumentation is used in the BHA to drill the wellbore. In FIG. 3, the hazard characterization (calculation) data are displayed at 36.

In some embodiments, drilling hazard characterization may change as a result of encountering a "near miss", as shown at 38. A near miss may be described as an event during wellbore drilling which did not result in substantial lost operating time, or may be described as encountering a drilling hazard having sufficiently small consequences or insignificant cost to repair, as to be conventionally regarded as not actually having encountered a drilling hazard. For example, "gas cut" of the drilling mud during drilling may require some increase in mud weight to avoid more serious consequences, but may otherwise not be recorded in a typical driller's record as the equivalent of taking a kick. However, gas cut mud is one indication of rising formation fluid pressure, and when the data relating to the formations penetrated which result in the gas cut, and the magnitude of the gas cut, are entered 46, into the database (18 in FIG. 1), it may be the case that risk of taking a kick in deeper earth formations, as recalculated 48 in the computer (10 in FIG. 1), may increase to a point that in the operator's judgment such risk becomes unacceptable. This situation may, in the operator's judgment, require a change in the proposed well plan. The change in well plan would be effective starting from the current wellbore position along the initial well plan at the time of the near miss event. Alternatively, the wellbore may be allowed to progress as originally planned if the recalculated risk/consequences are determined to be acceptably small. In either case, the near miss data are used to update the data in the database (18 in FIG. 1) to enable recharacterization of drilling hazards in respect of the newly acquired data. As is the case for any other form of data acquired during drilling of the wellbore, the recharacterization may take place substantially in real time, or may be performed at selected times by the system operator.

In other drilling cases, an actual hazard may be encountered, as shown at 40. Magnitude of consequences of the encountered hazard, and the action needed to remedy the consequences of encountering the hazard, as shown at 44, are then entered, as shown at 46, into the database (18 in FIG. 1). The entered hazard data are then used to recharacterize, as shown at 48, any other hazards expected along the remaining (undrilled) part of the proposed wellbore. It may also be the case that encountering a hazard results in new hazards being determined to exist where the prior characterization did not make such determination. In either event, the recharacterized drilling hazards may cause the system operator to elect to change to one or more aspects of the remaining (as yet undrilled) part of the initial or adjusted well plan. Example of recharacterized hazards include (but are not limited to) recalculation of risk of taking a kick where initial formation fluid pressure estimates were based primarily on surface seismic survey interpretation. As is known in the art, resistivity measurements made during drilling of a wellbore (such as by LWD) may be used to estimate pressure in formations as yet to be drilled. An estimate of pressures made during drilling from MWD resistivity may not reflect the actual formation fluid pressure because the only "calibration" of the resistivity information is based on surface seismic surveys. Taking a kick, for example, would provide a pressure calibration with respect to LWD resistivity, so that the remainder of the well could be drilled relatively more safely, and any future wellbores in the same area would be planned in respect of the pressure data acquired as a result of the kick. Similar results may also be obtained using formation fluid pressure tests or gas cut in the absence of actually taking a kick.

In some embodiments, the encountered hazard data may result in recharacterization of hazards in proposed wellbores which are not yet drilled. In this event, the operators of such as-yet-undrilled wells may adjust the initial well plans of such as-yet-undrilled wells according to the process described with respect to FIG. 2 to reduce the calculated risk and/or consequences of encountering such hazards.

Figure 4:
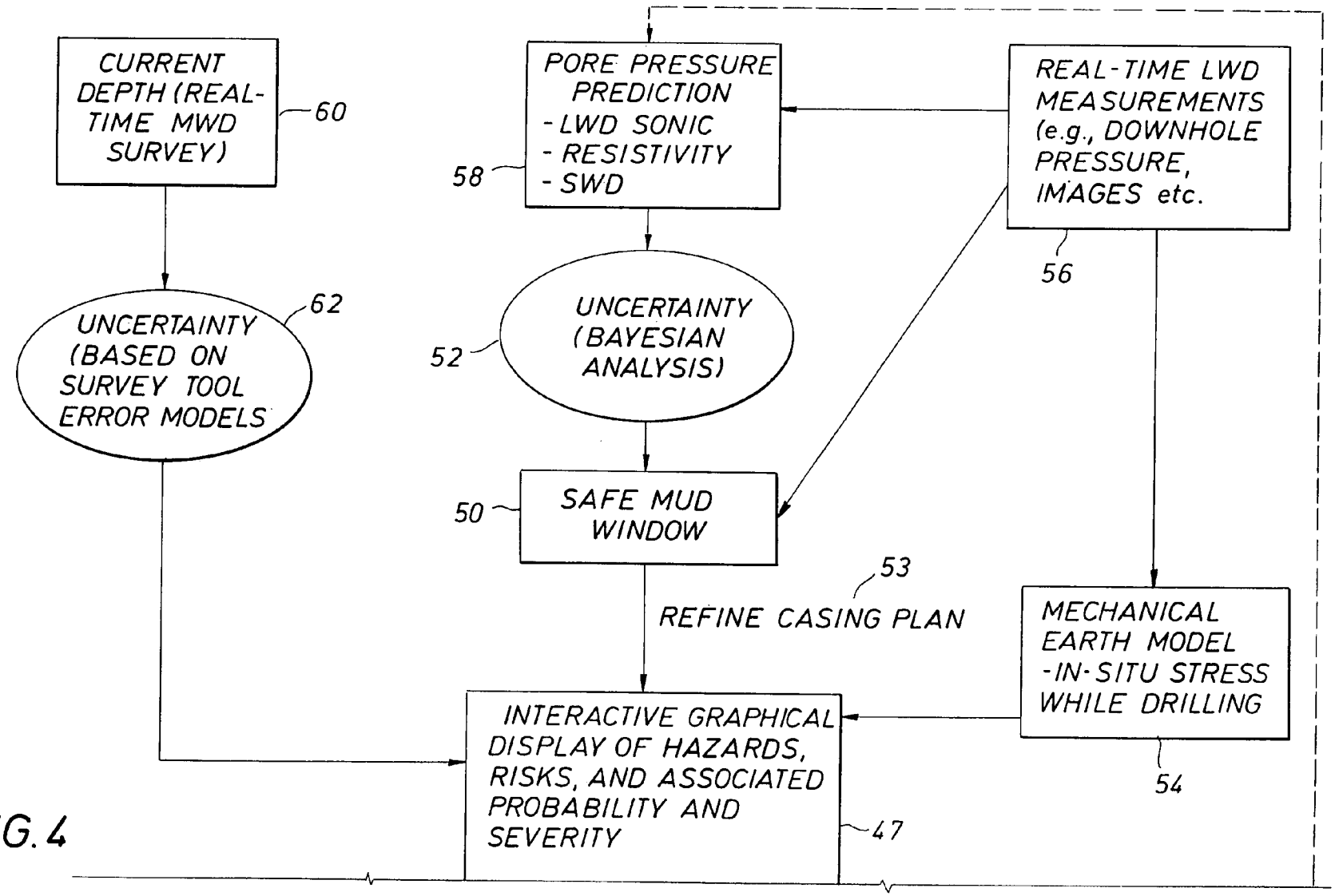
FIG. 4 show a flow chart of one example of updating a shared earth model using offset well data and data acquired during drilling of a wellbore.
Figure 4:
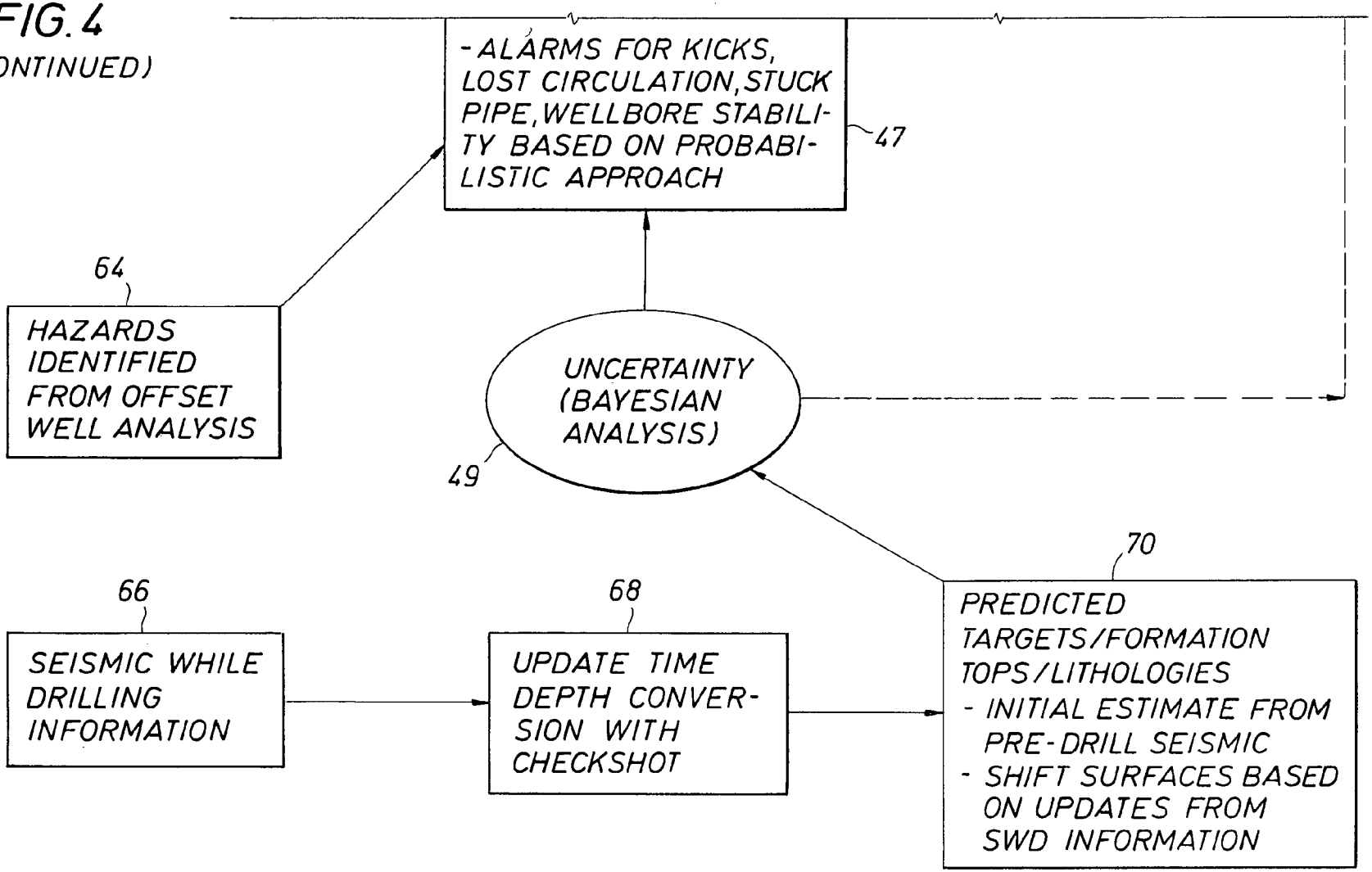

A general overview of how a method according to the invention can be used during drilling of a wellbore to update or adjust a well plan is shown in FIG. 4. At 47 an interactive display includes the position along the proposed wellbore trajectory of any drilling hazards previously determined from analysis of offset well data 64 where available, or from other sources such as seismic surveys and geologic analyses of similar geologic environments to the one in which the wellbore is being drilled. During the drilling of the wellbore, the position in space of each point along the actually drilled part of the wellbore trajectory is determined from survey measurements such as single-shot, multishot magnetic surveys, gyroscopic surveys or measurement while drilling (MWD) surveys. The actual display format used is a matter of choice for the system designer, but as explained previously in the Background section herein, three-dimensional (3-D) projections of expected subsurface formation structures, and wellbore trajectories plotted thereon, provide advantages in ability of the system operator to evaluate drilling hazards and corrective action therefor. One type of 3-D display is described in, J. Holt et al, *Mungo Field: Improved Communication through 3D Visualization of Drilling Problems,* paper no. 62523, Society of Petroleum Engineers, Richardson, Tex. (2000). The display described in the Holt et al. reference includes a projection of 3-D subsurface structure with proposed well trajectories plotted thereon, including a color-coded representation of type of hazard, magnitude of the risk of encountering the hazard, and severity of consequences of encountering the specific drilling hazard along the proposed wellbore trajectory. Other advantageous types of hazard displays will be further explained.

The operator has the ability, in this embodiment, to adjust any element of the initial well plan, including but not limited to trajectory, BHA configuration and/or bit type, casing depths, drilling fluid densities, and any drilling operating parameters such as rotary speed, weight on bit and mud flow rate. Changing prior planned drilling operating parameters may affect ROP in selected segments of the wellbore, and may in some cases be determined during recharacterization to reduce drilling hazard risk and/or consequences. The drilling hazards are recharacterized and then displayed for review by the system operator. The system operator may change any of the well plan elements again, and the computer (10 in FIG. 1) will recharacterize the drilling hazards and display them in the selected manner. This process may be repeated, in some embodiments, until the risk, consequences and/or cost to remedy any drilling hazards are believed by the system operator to be acceptable. In some embodiments, an adjusted well plan may be determined when the risk of encountering any particular hazard is minimized. Alternatively, an adjusted well plan may be determined when consequences of encountering any particular drilling hazard are minimized. Yet another alternative would be to have the well plan adjusted so that the expected cost to drill the wellbore is minimized. Such a minimum cost calculation would take into consideration factors such as the incremental cost of drilling the well (such as that daily cost to operate a drilling rig), and the amount of lost operating time expected as a result of encountering and repairing any particular drilling hazard.

As is known in the art, the true position in space of every point along the wellbore is subject to some degree uncertainty as a result of inherent inaccuracy and imprecision in the survey measurements made by the selected survey instrument. The uncertainty in one embodiment, as shown at 62, can be estimated using a Bayesian method, as previously explained, to provide a probability distribution of the likely absolute position of every point along the drilled wellbore trajectory. Other embodiments may include calculation of positional uncertainty of the wellbore according to the accuracy limits of the survey instrument that are well known in the art. The probability distribution of the wellbore position will affect the probability of and the degree of severity of encountering the previously determined drilling hazards. As the wellbore is being drilled, and the probability distribution 62 of the position of the wellbore in space is determined, a recalculation of the risk of encountering and the severity of the consequences of encountering any of the drilling hazards is performed and displayed, at 47. A probability distribution of the likely position of the wellbore at each point along the trajectory can be calculated according to a method adapted from the '920 patent application referred to previously herein, or by other methods known in the art.

As shown in box 47 in FIG. 4, alarms or other types of indicators may also be provided or otherwise included with the display 47 to particularly call to the attention of the system operator the existence of any risk of preselected probability, or consequence of any preselected magnitude. In the interactive display 47, the system operator can adjust any of the elements of the initial or adjusted well plan, including wellbore trajectory, expected drilling fluid density, casing depths and sizes, among other wellbore plan elements. The adjustment is made to determine any changes in the risk and/or consequences of drilling hazards as a result of adjusting the well plan elements. The system operator can then review the recalculated display 47. As is the case for the type of display, the actual type of alarm or indicator is a matter of discretion for the system designer. One suitable example of an alarm for representing likelihood of taking a kick, for example, is shown in U.S. Pat. No. 5,952,569 issued to Jervis et al. In general terms, an alarm may be a representation on a display or an actuation of a device intended to call the attention of the system operator when a value of a selected parameter crosses a selected threshold.

As previously explained, positions in space of various target and/or hazard-bearing earth formations can be initially estimated using offset wellbore data and/or surface-conducted seismic survey data. Preferably, these initial estimates of position are also made using a Bayesian probability distribution analysis of the most likely positions. In some embodiments of the invention, a correlation between the spatial position of these formations and initial seismic-survey derived estimates of the spatial positions, can be udpated using seismic while drilling data, at 66. Seismic while drilling may in some embodiments be a "checkshot" survey, in which a seismic receiver is positioned at selected intervals along the wellbore, and a seismic source is actuated at the earth's (or ocean) surface. Measurements from the receiver are used to determine, among other data, a seismic travel time from surface to each of the selected positions in the wellbore. Other seismic while drilling methods known in the art include drill bit-source VSP surveys such as a service sold under the trade name DBSeis by Schlumberger Technology Corporation, Sugar Land, Tex., also the assignee of the present invention. The seismic while drilling data are used, at 68, to recalculate or update a time/depth conversion of any seismic surveys made entirely at the earth's surface. Previously determined estimates of formation positions in space and estimates of expected formation lithologies and fluid pressures may be redetermined, at 70, using the seismic data obtained during drilling of the wellbore. As is the case for the spatial position of the wellbore trajectory, at 62, the probability distributions of the positions in space, lithologies and fluid pressures, are preferably determined, at 49, using a Bayesian probability distribution calculation method such as disclosed in the '920 application. Based on the revised determinations of the spatial positions, lithologies and fluid pressures of formations to be drilled in the wellbore, risk and severity of hazards may be recalculated and shown on the display 47.

Methods for estimating formation fluid pressures before drilling a well, and for refining those estimates based on formation data obtained during and after drilling, are known in the art. The revised estimates of positions in space, at 49, may be used in conjunction with data obtained during the drilling of the wellbore, at 58, which may include acoustic velocity measurements, formation resistivity measurements, and wellbore pressure measurements, to revise any previously made predictions of expected formation fluid pressures. The revisions to the fluid pressure estimates may also be used to generate a probability distribution, at 52, of the most likely expected fluid pressures, in respect of uncertainty in the measurements used to refine the earlier estimates, and the inherent uncertainty in the method of making the pressure estimates. The revised formation fluid pressure estimates are used, at 50, to estimate probable minimum and maximum safe drilling fluid densities ("safe mud window"). The revised estimates of minimum and maximum safe drilling fluid densities may then be used to recalculate the risk of encountering, and the severity if encountered, of drilling hazards. The recalculated risks and severities are displayed at 47.

At 56, measurements made during the drilling of the wellbore may include, for example, wellbore pressure measurements, images (such as from resistivity or acoustic reflectance) of the surface of the wellbore, and formation parameters such as acoustic compressional and shear velocities. Such measurements may be used to estimate in-situ stress of the earth formations, as shown at 54. Methods for determining in-situ stress from well log measurements and seismic surveys are known in the art. Calculation of in-situ stress is used in some embodiments of the invention to determine risk of one cause of stuck pipe, namely collapse of the wellbore where the in-situ stress may exceed the strength of the formations penetrated by the wellbore with respect to the trajectory of the wellbore. Methods for determining the risk of wellbore collapse, and consequent risk and severity of a stuck pipe hazard are described, for example, in N. Last et al., *An Integrated Approach to Evaluating and Managing Wellbore Instability in the Cusiana Field, Colombia, South America,* paper no. 30464, Society of Petroleum Engineers, Richardson, Tex. (1995). Other factors which may result in stuck pipe, and techniques for mitigating the effects of stuck pipe, are described, for example, in U.S. Pat. No. 5,508,915 issued to Tsao et al, and in Q. Sharif, *A Case Study of Stuck Drillpipe Problems and Development of Statistical Models to Predict the Probability of Getting Stuck and if Stuck, the Probability of Getting*

*Free,* Ph.D. thesis, The Texas A & M University (1997). Risk of stuck pipe, and the degree of severity of a stuck pipe event, as previously explained, can be displayed graphically at 47. As for the other drilling hazards, the risk of encountering and the consequences of encountering stuck pipe are preferably determined according to a Bayesian probability distribution calculation, such as one disclosed in the '920 patent application referred to earlier herein.

Figures 5, 7:
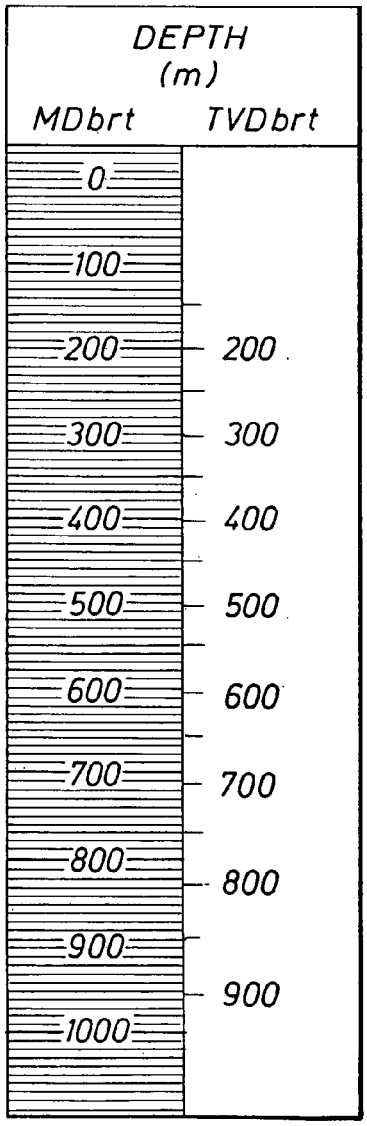
FIG. 5 shows a depth track forming part of one example of a display according to a method of the invention.
FIG. 7 shows a corresponding textual description of drilling hazards displayed in graphic form as in FIG. 6.
Figure 6:
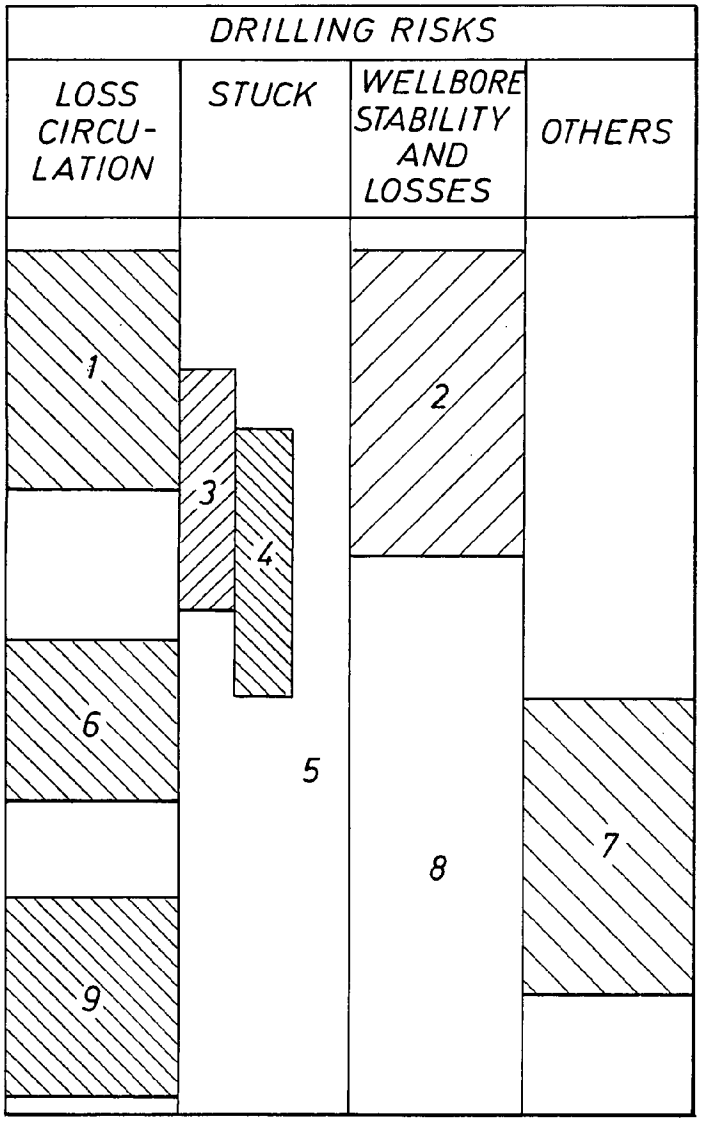
FIG. 6 shows one example of a drilling hazard display calculated according to a method of the invention.

After characterization, the drilling hazards should be displayed in a manner suitable for evaluation by the system or wellbore operator. A particularly advantageous form of display of drilling hazards determined using the method of the invention is shown in FIGS. 5–8. FIG. 5 shows a depth "track" presented as a conventional scale or grid calibrated in measured depth (length along the wellbore trajectory) and true vertical depth. Methods for generating such displays are well known in the art. FIG. 6 shows a preferred example for indicating the probability of and severity of drilling hazards being encountered along the wellbore trajectory. The display shown in FIG. 6 is preferably correlated to the depth display of FIG. 5. Using this kind of depth correlated display, the system operator will be able to view the drilling hazards which may be encountered during the drilling of the wellbore with respect to their position along the wellbore trajectory. In the display of FIG. 6, each hazard is categorized as to its severity of effect by a shading code or color code. The probability of occurrence my be categorized by the one of color code or shading code not used to represent the severity of consequences. The numbers 1–9 in each one of the identified hazards corresponds to a textual description of each hazard and possible remedial action which may be taken to avoid the hazard or to ameliorate its effects if the hazard is encountered. An example of corresponding textual description is shown in FIG. 7, where hazards 1–8 from FIG. 6 are described by text indicated by the corresponding reference numeral.

Figure 8:
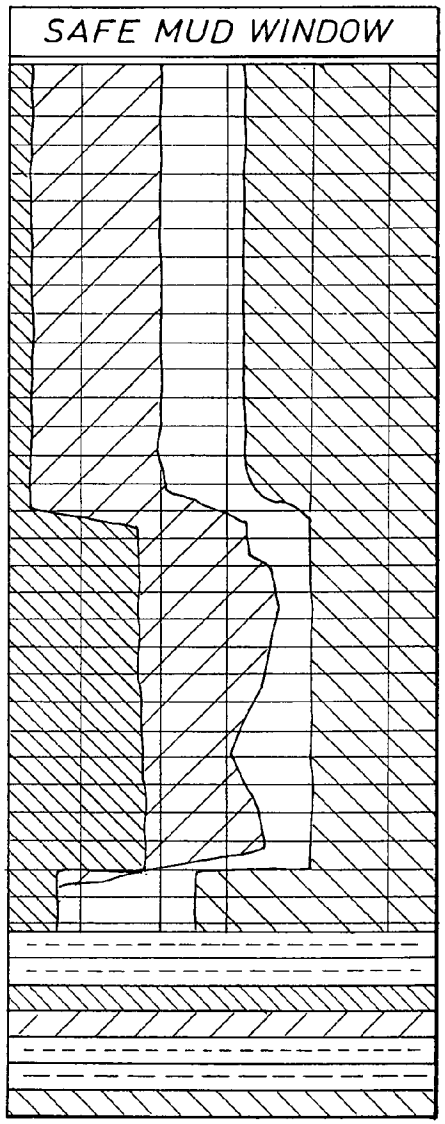
FIG. 8 shows one example of a wellbore stability plot according to a method of the invention.

FIG. 8 shows one example of a "wellbore stability" display, which may include, with respect to depth (track shown in FIG. 6) an expected formation fluid pressure, an expected formation fracture pressure, and proposed drilling fluid density (mud weight). The display of FIG. 8 may assist the operator by showing places where differentially stuck pipe, taking a kick and or lost circulation may be encountered by a representation of the expected pressures.

In each of the example displays of FIGS. 5–8, the system operator may change various elements of the proposed well plan, including trajectory, drilling fluid densities, casing depths and wellbore diameter along the wellbore to evaluate the risks and consequences of encountering drilling hazards. In cases where the risks and/or consequences of particular hazards are believed to be too high, the system operator may change one of more elements of the well plan, as previously explained, and review the recalculated drilling hazard risks and consequences. For example, after changing one or more elements of the proposed well plan, some of the drilling hazards (1–8 in FIG. 6) may no longer appear on the hazard display. Conversely, other hazards not previously shown may appear on the hazard display. The system operator may in response choose to further change the one or more elements of the proposed well plan, again evaluating the displayed hazards, until a suitable well plan is determined.

Similarly, and as explained with reference to FIGS. 2 and 4, during drilling of a wellbore, measurements of earth formation properties and seismic travel time may be made. These measurements may be used in some embodiments to recalculate the risk and consequences of the various drilling hazards to be encountered on the as yet undrilled portion of the wellbore. It is also possible, in some cases, that a new drilling hazard becomes identified as likely based on the measurements made during drilling, or that a previously identified hazard is later determined to be unlikely based on the measurements made during drilling. Such redeterminations of drilling hazard risk and consequences will be displayed (47 in FIG. 4) whereupon the system operator may elect to change at least one element of the remaining portion of the well plan in response thereto. Just as for an initial well plan, the system operator may change the one or more elements of the plan for the undrilled portion of the well, reevaluate hazards, and continue the change and reevaluation until a suitable plan for the undrilled portion of the wellbore is obtained.

A suitable adjusted well plan for drilling a wellbore may be determined with respect to a number of different criteria. In some cases, the wellbore operator may wish to reduce the total amount of lost time (time spent not in active drilling of additional wellbore) caused by the need to remedy the effects of having encountered drilling hazards. When each type of drilling hazard is characterized, the likely consequences preferably include the type and amount of effort needed to remedy the problem caused by the drilling hazard. For example, taking a kick may include a calculatable amount of time needed to circulate out the fluid influx in the wellbore, and an amount of weighting material needed to increase the drilling fluid density to overcome the formation fluid pressure. As another example, a stuck pipe hazard may include an amount of circulating and jarring time necessary to dislodge the stuck pipe, and possible set an additional casing string or include a lubricity agent to reduce the probability of sticking the pipe again. As yet another example, it may be known that maintaining a selected rotary drilling speed (RPM) increases the drilling rate of penetration (ROP), but when particular BHA configurations are used, a destructive BHA failure resulting from vibration may result. An amount of time, and cost necessary to replace the broken BHA components can be estimated prior to the hazard, and will form part of the operator's decision making process.

In each of the foregoing hazard examples, the operator may elect to accept the hazard risk, based on a calculation by the computer (10 in FIG. 1) that a most likely outcome would provide a minimum economic cost to drill the wellbore according to an optimized well plan. An economic cost will depend on, among principal factors, a cost of operating a drilling rig used to drill the wellbore. In some cases, the operator may determine that a particular degree of risk is unacceptable because of the amount of time likely to be needed to repair the consequences of encountering a particular drilling hazard. In some cases, therefore, the operator may adjust the well plan to provide a minimum amount of likely lost operating time. In still other cases, it may be known that certain types of drilling hazards have such extreme probable consequences, that it is preferable to adjust the well plan to minimize the risk of encountering such hazards, even if the most likely economic cost and/or lost time would otherwise be acceptable. An example of such a case would include taking a kick in a wellbore drilled in very deep ocean water, where fracture pressures of earth formations below the sea floor are relatively limited by the low overburden of the sea water above.

While the invention has been described with respect to a limited number of embodiments, those skilled in the art will appreciate that other embodiments can be devised which do not depart from the scope of the invention as disclosed herein. Accordingly, the scope of the invention should be limited only by the attached claims.

What is claimed is:

1. A method for characterizing a drilling event in a proposed wellbore, comprising:

determining a well plan including at least a wellbore trajectory;

estimating a likelihood of occurrence of, a position along the trajectory and a severity of consequences of at least one drilling event; and displaying on a representation of at least a portion of the wellbore trajectory, at least one of the position of, the likelihood and the severity of the at least one drilling event.

2. The method as defined in claim 1 wherein the estimating the position, likelihood and severity is performed by determining a Bayesian uncertainty thereof based on a correlation of the well plan to an earth model of earth formations along the wellbore trajectory.

3. The method as defined in claim 2 wherein the earth model is generated from at least one of offset wellbore data, seismic survey data and correlative wellbore data from similar earth formations distal from a location of the proposed wellbore.

4. The method as defined in claim 1 further comprising:

adjusting at least one well plan parameter;

recalculating at least one of the position, the likelihood and the severity of the at least one drilling event; and repeating the displaying.

5. The method as defined in claim 4 further comprising:

repeating the adjusting and recalculating until at least one of a most likely cost to drill a wellbore, an estimated amount of lost time and a likelihood of encountering the at least one drilling event is minimized.

6. The method as defined in claim 4 wherein the at least one well plan parameter comprises one of casing depth, dog leg severity, and mud weight.

7. The method as defined in claim 4 wherein the at least one well plan parameter includes at least one drilling operating parameter.

8. The method as defined in claim 7 wherein the at least one drilling operating parameter comprises at least one of weight on bit and rotary speed.

9. The method as defined in claim 1 wherein the at least one drilling event comprises at least one of stuck pipe, lost circulation, taking a kick and BHA component failure.

10. The method as defined in claim 1 wherein the displaying comprises presenting a graphic cylinder on the representation at the position, a diameter of the cylinder related to the likelihood, a length of the cylinder related to the severity and a color of the cylinder related to a type of the at least one drilling event.

11. The method as defined in claim 1 wherein the displaying comprises presenting with respect to depth in the wellbore at least one of a color coded and shade coded indicator, the indicator corresponding to one of the likelihood of and the severity of the drilling event.

12. The method as defined in claim 11 further comprising a reference indicator disposed proximate to the at least one of the color coded and shade coded indicators, the reference indicator tied to a textual description of at least the type of drilling event.

13. A method for optimizing a well plan for a proposed wellbore, comprising:

selecting an initial well plan comprising at least a wellbore trajectory;

determining for the initial well plan a position along the trajectory, a likelihood of occurrence, and a severity of consequence of encountering at least one drilling event;

adjusting at least one parameter of the initial well plan;

redetermining the position, likelihood and severity of the at least one drilling event; and repeating the adjusting and redetermining until at least one of a most likely cost to drill a wellbore, an amount of lost time and a likelihood of encountering the at least one drilling event is minimized.

14. The method as defined in claim 13 wherein the determining and the redetermining the position, likelihood and severity are performed by determining a Bayesian uncertainty thereof based on a correlation of the well plan on an earth model of earth formations along the wellbore trajectory.

15. The method as defined in claim 14 wherein the earth model is generated from at least one of offset wellbore data, seismic survey data and correlative wellbore data from similar earth formations distal from a location of the proposed wellbore.

16. The method as defined in claim 13 wherein the at least one well plan parameter comprises one of casing depth, dog leg severity, and mud weight.

17. The method as defined in claim 15 wherein the at least one well plan parameter includes at least one drilling operating parameter.

18. The method as defined in claim 15 wherein the at least one drilling operating parameter comprises at least one of weight on bit and rotary speed.

19. The method as defined in claim 1 wherein the at least one drilling event comprises at least one of stuck pipe, lost circulation, taking a kick and BHA failure.

20. The method as defined in claim 13 further comprising displaying in graphic form at least one of the position, likelihood and severity of the at least one drilling event for evaluation by a system operator.

21. The method as defined in claim 20 wherein the displaying comprises presenting a graphic cylinder on the representation at the position, a diameter of the cylinder related to the likelihood, a length of the cylinder related to the severity and a color of the cylinder related to a type of the at least one drilling event.

22. The method as defined in claim 20 wherein the displaying comprises presenting with respect to depth in the wellbore at least one of a color coded and shade coded indicator.

23. A method for drilling a well, comprising:

selecting an initial well plan comprising at least a wellbore trajectory;

starting drilling the well according to the initial well plan;

measuring at least one of a drilling operating parameter and an earth formation characteristic during the drilling;

determining at least one of a position along the trajectory, a likelihood of encountering and a severity of occurrence of at least one drilling event in response to the measuring;

adjusting at least one parameter of the initial well plan for an unfinished portion of the well;

redetermining the position, likelihood and severity of the at least one drilling event;

repeating the adjusting and redetermining until for the unfinished portion of the well at least one of a most likely cost to drill, an amount of lost time and a likelihood of encountering the at least one drilling event is minimized; and drilling the unfinished portion of the well according to the adjusted well plan.

24. The method as defined in claim 23 wherein the determining and redetermining the position, likelihood and severity are performed by determining a Bayesian uncertainty thereof based on a correlation of the initial well plan to an earth model of earth formations along the wellbore trajectory.

25. The method as defined in claim 24 wherein the earth model is generated from at least one of offset wellbore data, seismic survey data and correlative wellbore data from similar earth formations distal from a location of the proposed wellbore.

26. The method as defined in claim 25 wherein the earth model is redetermined using data from the measuring, and the Bayesian uncertainty is determined by correlating the adjusted initial well plan to the redeterdmined earth model.

27. The method as defined in claim 23 wherein the at least one well plan parameter comprises one of casing depth, dog leg severity, and mud weight.

28. The method as defined in claim 23 wherein the at least one well plan parameter includes at least one drilling operating parameter.

29. The method as defined in claim 28 wherein the at least one drilling operating parameter comprises at least one of weight on bit and rotary speed.

30. The method as defined in claim 23 wherein the at least one drilling event comprises at least one of stuck pipe, lost circulation, taking a kick and BHA failure.

31. The method as defined in claim 23 further comprising displaying in graphic form the position, likelihood and severity of the at least one drilling event for evaluation by a system operator.

32. The method as defined in claim 31 wherein the displaying comprises presenting a graphic cylinder on the representation at the position, a diameter of the cylinder related to the likelihood, a length of the cylinder related to the severity and a color of the cylinder related to a type of the at least one drilling event.

33. The method as defined in claim 31 wherein the displaying comprises presenting with respect to depth in the wellbore at least one of a color coded and shade coded indicator.

* * * * *